US009278381B2

(12) United States Patent
Porat et al.

(10) Patent No.: US 9,278,381 B2
(45) Date of Patent: Mar. 8, 2016

(54) POOL CLEANER BASE PLATE WITH HIGH PRESSURE CLEANING JETS

(71) Applicant: Aqua Products, Inc., Cedar Grove, NJ (US)

(72) Inventors: Joseph Porat, Del Ray Beach, FL (US); Giora Erlich, North Caldwell, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 570 days.

(21) Appl. No.: 13/633,345

(22) Filed: Oct. 2, 2012

(65) Prior Publication Data

US 2013/0092193 A1 Apr. 18, 2013

Related U.S. Application Data

(60) Provisional application No. 61/547,495, filed on Oct. 14, 2011.

(51) Int. Cl.

| | |
|---|---|
| ***E04H 4/16*** | (2006.01) |
| ***B08B 3/02*** | (2006.01) |
| ***B08B 9/093*** | (2006.01) |

(52) U.S. Cl.

CPC ..... *B08B 9/093* (2013.01); *E04H 4/1636* (2013.01); *E04H 4/1654* (2013.01); *E04H 4/1663* (2013.01)

(58) Field of Classification Search

CPC ..... E04H 4/16; E04H 4/1654; B08B 2209/08

USPC ..... 15/1.7

See application file for complete search history.

(56) References Cited

U.S. PATENT DOCUMENTS

| | | | | |
|---|---|---|---|---|
| 5,336,403 | A * | 8/1994 | Marbach | 210/167.17 |
| 6,412,133 | B1 | 7/2002 | Erlich et al. | |
| 7,316,751 | B2 | 1/2008 | Horvath et al. | |
| 2008/0236628 | A1 | 10/2008 | Horvath et al. | |
| 2010/0058546 | A1 * | 3/2010 | Erlich | 15/1.7 |

* cited by examiner

*Primary Examiner* — Michael Kornakov
*Assistant Examiner* — Natasha Campbell
(74) *Attorney, Agent, or Firm* — Abelman, Frayne & Schwab

(57) ABSTRACT

The base plate of a robotic or manually propelled tank or pool cleaning apparatus includes a transverse conduit positioned on the interior surface of the base plate and is in fluid communication with a source of pressurized water that is also located within the pool cleaner's housing, which pressurized water is discharged from the bottom or lower portion of the transverse conduit through a plurality of openings that extend along a line that is transverse to the longitudinal axis of the pool cleaner's direction of travel, to produce downwardly-directed water jets that are discharged through and below the base plate towards the surface of the pool or tank over which the pool cleaning apparatus is moving to dislodge and suspend dirt and debris that is then drawn into and retained by the pool cleaner's filter.

16 Claims, 4 Drawing Sheets

FIG. 4
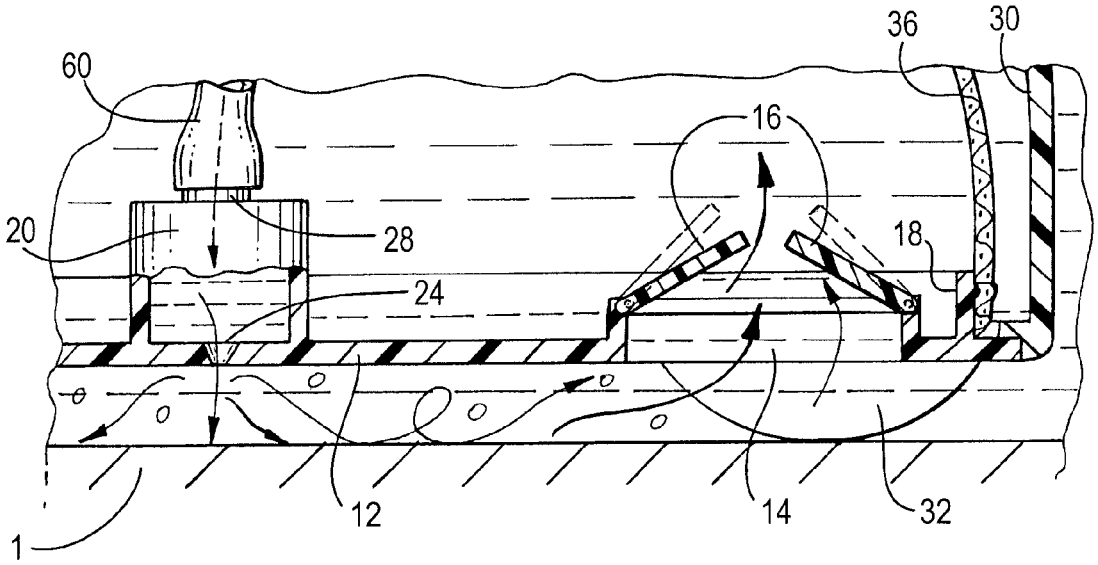
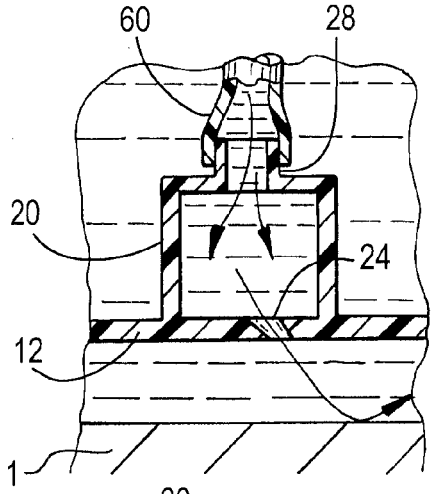
FIG. 5
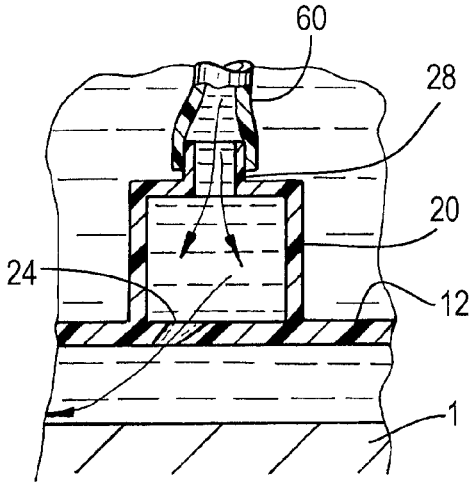
FIG. 6
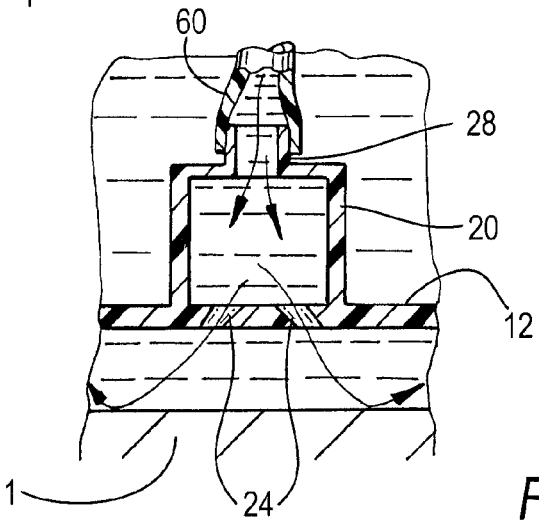
FIG. 7

FIG. 8
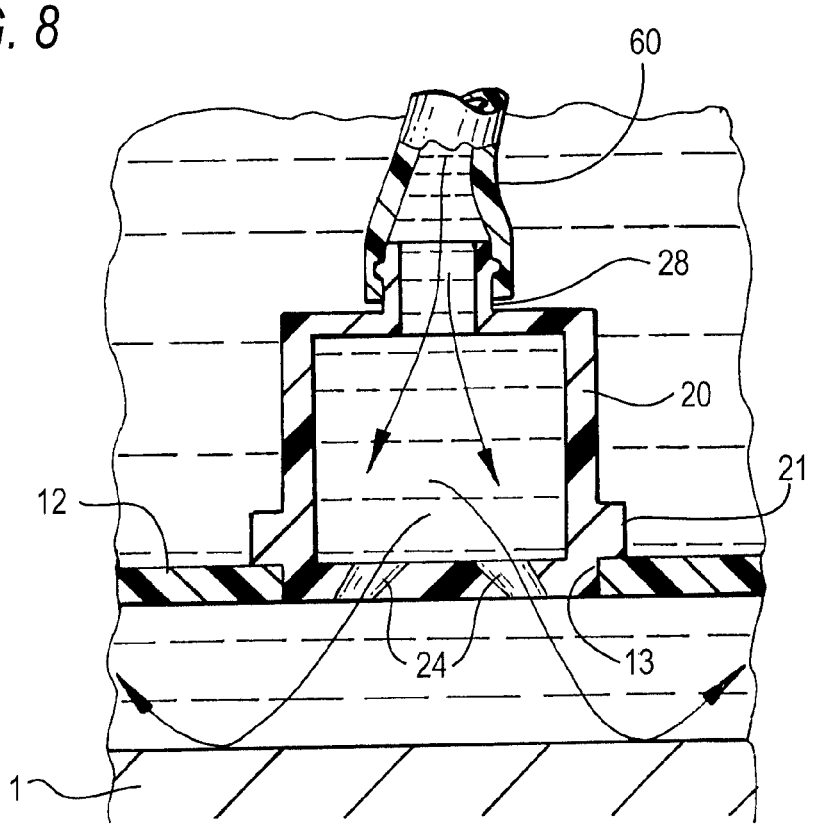
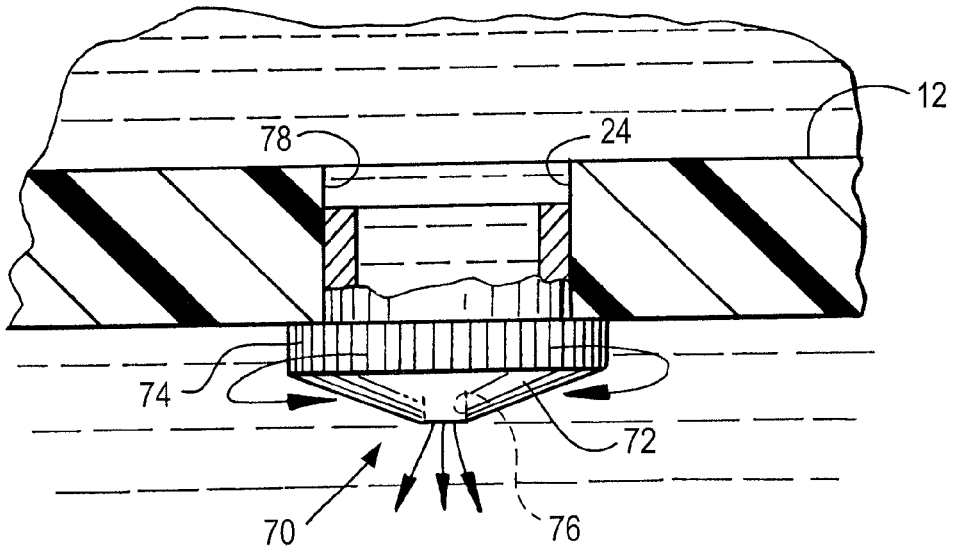
FIG. 9

POOL CLEANER BASE PLATE WITH HIGH PRESSURE CLEANING JETS

CROSS REFERENCES TO RELATED APPLICATIONS

This application claims priority to provisional application 61/547,495 filed Oct. 14, 2011.

FIELD OF THE INVENTION

This invention relates to an improved base plate for hand-powered and self-propelled pool and tank cleaners that draw water containing dirt and debris from the surface beneath the moving pool cleaner for entrainment in a filter.

BACKGROUND OF THE INVENTION

It is now well known in the art to equip robotic and other types of tank and pool cleaners with means for discharging water jets under the cleaner body that are directed toward the surface over which the cleaner is passing in order to agitate and lift debris towards one or more vacuum or low water pressure intake openings to enhance the cleaning ability of the apparatus. The suspended dirt and debris created by the water jet turbulence renders the material temporarily buoyant so that it can be drawn into the interior of the pool cleaner housing and eventually entrained or captured by the pool cleaner filter system. For example, a number of different systems and pool cleaning apparatus are described in related U.S. Pat. No. 7,316,751. In most of the embodiments described in that patent, the water jet emanates from the ends of conduits that are mounted, at east in part, on the exterior of the pool cleaner housing. The open ends of these conduits from which the water jets emanate are shown positioned below the base plate, that is, they are closer to the surface over which the pool cleaner is passing than the generally planar exterior surface of the base plate. This positioning of the ends of the high pressure water delivery conduits is necessary in order to direct the water jets towards the water inlet openings in the base plate into which the water to be filtered is drawn.

In the embodiment of FIGS. 12-15 of U.S. Pat. No. 7,316,751, the pressurized water delivery conduits (4) are positioned within the pool cleaner housing. A single nozzle is apparently permanently attached to the base plate on either side of a single longitudinal inlet opening (11) in the base plate. As depicted in FIG. 12, the outlet opening is oval, representing a section taken at an acute angle through the end of the conduit (70).

In the embodiments of FIGS. 17-19 of U.S. Pat. No. 7,316,751, external manifolds are positioned across the opposite ends of the pool cleaner transverse to the direction of movement. Each manifold has a plurality of water jets, described as being directed either downwardly or at an angle in order to discharge the water jets towards the underside of the base plate in the direction of the water inlet opening(s). In the description of FIG. 17, it is indicated that each of the discharge openings (102) is provided with a low-friction fitting to minimize the back pressure, presumably to reduce the adverse effect on the forward movement of the apparatus, although this is not stated. It is noted that in addition to being on the exterior of the pool cleaner, the transverse manifolds of FIG. 17 are positioned at some distance outward of the ends of the housing making them vulnerable to impact while in use in the pool and when they are placed in storage; and also locating them in a position that a user might naturally treat as a convenient handle while lifting the unit to or from the pool or carrying the unit to a storage location.

Although the various configurations and arrangements of water jets directed below the base plate disclosed in U.S. Pat. No. 7,316,751 can serve to effectively raise dirt and debris to facilitate its capture and passage through the one or more openings in the base plate for filtering, those configurations in which the high pressure water delivery tube and water jet nozzles or manifolds are on the exterior of the housing create a problem of potential damage from mishandling by the user, or contact with those in the pool with the pool cleaner, as well as damage from impact with obstacles such as pool ladders, stair steps and other obstacles that project from the pool surface or its walls. Furthermore, the cost in materials and labor, both in the manufacture and assembly stages, associated with providing multiple pressurized water delivery tubes to individual water jets, is significant.

It is therefore an object of the present invention to provide an apparatus and system to resolve these problems in a cost effective manner and to provide a solution in which the water jet delivery system is protected from potential damage by mishandling and/or impact. It is also an object of this invention to provide a solution which can be readily adapted for use in manufacturing new pool cleaners and in retrofitting existing pool cleaners by providing an improved base plate that is configured to replace existing base plates in prior art cleaners.

For convenience, the term "pool cleaner" or "cleaner" as used in describing the invention will be understood to encompass both pool and tank cleaners.

SUMMARY OF THE INVENTION

In accordance with the present invention, the interior or internal surface of the base plate of a tank or pool cleaning apparatus is provided with a transverse conduit that is in fluid communication with a source of pressurized water that is discharged from the bottom or lower portion of the transverse conduit through a plurality of openings that extend generally along a line that is transverse to the longitudinal axis of the pool cleaner's direction of travel, to produce downwardly-directed water jets that are discharged towards the surface of the pool or tank over which the pool cleaning apparatus is moving.

In one embodiment, the base plate is formed from a polymeric material, e.g., as by molding, and at least a portion of the transverse conduit is integrally molded with the base plate. In order to facilitate the molding and assembly of the unitary base plate and conduit, a portion of the base plate forms the bottom wall and the side and end walls of the conduit are simultaneously molded and integrated into the base plate. The top wall or upper portion of the conduit is formed as a separate member which is then secured to the upwardly projecting end and sidewall portions of the conduit in watertight relation to complete the conduit assembly. The top portion or member can be secured by adhesive means, mechanical fasteners, by a snap-fit engagement, or any other common mechanical means that are well known in the art.

In an embodiment, the end and sidewalls are conveniently molded as an integral rectilinear enclosure extending transversely across the base plate with the vertical end walls positioned inside of the area in which a removable flexible mesh filter assembly and retaining mechanism is positioned. In this embodiment, the top cover member of the transverse conduit can be provided with a projecting tubular member, also most conveniently integrally molded to form a unitary assembly. The tubular member is configured to receive a conduit containing pressurized water that is delivered from a pump or other pressurized source to the interior of the transverse conduit. The source of pressurized water and the delivery conduit are preferably and advantageously positioned on the interior of the pool cleaner housing for protection so as not to be subject to mishandling or dislocation during the operation and/or transport of the pool cleaner when the exterior of the apparatus can be subjected to an impact.

As will be understood by those of ordinary skill in the art, the base plate is provided with at least one inlet opening to which water is drawn from below the apparatus and into a filter assembly which retains dirt and debris and the filtered water is discharged through an opening in the housing or through a water jet directional drive mechanism. In the embodiment in which the base plate is provided with two water inlet openings, they are typically displaced outwardly from, and on opposite sides of the longitudinal center line of the apparatus as defined by its direction of travel. With a base plate of this configuration, the water jet outlet openings are advantageously positioned in spaced relation that corresponds to the transverse positioning of the respective inlet openings, thereby providing water jets directed towards the bottom surface beneath the apparatus in general alignment with the inlet openings in order to maximize the intake of suspended dirt and debris raised by the water jet turbulence.

In the embodiment in which the transverse conduit is, at least in part, integrally molded with base plate, the base plate can be provided with the plurality of openings extending from the exterior surface to the interior of the conduit during the molding operation. Alternatively, the outlet openings through which the pressurized water is discharged can be provided by drilling or other mechanical means, or thermally by a heated element that melts and displaces the polymer after the molded base plate has cured. The outlet openings can have a uniform cross-section or shape to provide a desired force or configuration to the water jets. Each of the outlet openings can have the same or different internal configuration, depending upon their location in the base plate and relative to the water inlet opening(s) in the base plate.

The outlet openings from the transverse conduit can be directed downwardly in a direction that is normal to the surface of the base plate or in a direction that is radially displaced from the normal toward either one or the other end of the apparatus; or a pair 5 of outlet openings located at the same transverse position can be positioned to produce water jets in multiple directions, including normal and angularly displaced.

In another embodiment of the present invention, the transverse conduit element can be separately manufactured, e.g., by molding, or by assembly of individual tubular elements having end caps, and provided with a water inlet. Although the cross-sectional configuration of the conduit can be rectilinear or curvilinear, or a combination thereof in this embodiment, a rectilinear configuration is preferred, since the conduit is installed in close-fitting relation into a corresponding opening formed in the base plate. The lower surface of the transverse conduit, which is provided with the plurality of pressurized water outlets that form the water jets, is mounted flush with the exterior surface of the base plate. The longitudinal sidewalls of the transverse conduit are advantageously provided with an outwardly extending shoulder or flange that rests on the interior surface of the base plate surrounding the opening. This flange can be continuous around the entire periphery or at selected positions. The base plate can be secured in a watertight relation to the conduit using an adhesive caulking material, a chemical bonding adhesive, ultrasonic bonding means and/or mechanical fasteners. Once installed in the base plate, the transverse conduit of this embodiment functions in the same manner as the integrally molded conduit described above.

In a further embodiment, the outlet openings can be formed to receive a separate nozzle member which can be adjustable or fixed to provide a jet stream. A manually adjustable nozzle affords the user with the beneficial opportunity of adjusting the configuration and/or force of the water jet that is emitted from the nozzle opening. This option can be particularly advantageous if the base plate of the pool cleaner is mounted at a relatively large distance from the surface that is being cleaned and additional force is required to raise the dirt and debris into suspension so that it can be more readily drawn into the water inlet openings leading to the filter device. As will be understood by those of ordinary skill in the art, the height of the base plate is related to the diameter of the moving support means, e.g., cleaning brushes positioned at either end of the apparatus, endless tracks, or axle-mounted wheels.

As will be understood from the above description, the base plate of the present invention can be configured for installation in a new cleaning apparatus at the time of manufacture, or dimensioned and configured as a replacement part for retrofitting of existing pool cleaners which are not so equipped to provide high pressure cleaning jets directed to the region beneath the base plate.

The configuration of the present invention in which the water jets emanate from the plane of the exterior of the base plate, solves the problem of potential damage to elements of the moving pool cleaner projecting below the base plate which contact obstacles, or even angled or sharply curved surfaces formed in the bottom of the pool, and also of such contact interfering with the programmed movement of the pool cleaner. Placing the transverse conduit inside of the pool cleaner housing and locating it on the interior surface of the base plate eliminates the potential problem of damage to the pressurized water delivery assembly by rough handling by the user and/or contact with exterior elements by those in the pool during the operation of the pool cleaning apparatus. The arrangement, location and configuration of the present invention also minimizes the problem of reducing the pressure of the water emanating from the pump by passage of the pressurized water through numerous fittings and constrictions which reduces the pressure of the water that is eventually discharged through the outlet openings in the transverse conduit. The present invention provides for more efficient operation of the water jet system, a savings in operational power costs and permits the use of a smaller pump, if desired.

BRIEF DESCRIPTION OF THE DRAWINGS

The invention will be described in further detail below and with reference to the attached drawings in which:

FIG. 4 is an enlarged side elevation sectional view of a portion of the cleaner of FIG. 1 taken along section line 4-4;

FIG. 5 is a cross-sectional end view of a detail of the transverse conduit of the invention illustrating one of the outlet openings at an angular displacement from the vertical;

FIG. 6 is a partial cross-sectional view similar to FIG. 5 illustrating a water outlet having a different angular displacement;

FIG. 7 is a partial cross-sectional view similar to FIG. 5 illustrating a pair of water outlets at different angular displacements;

FIG. 8 is a cross-sectional end view of an embodiment of the transverse conduit projecting through an opening in the base plate and supported and aligned by projecting longitudinal flanges; and FIG. 9 is an enlarged cross-sectional end view of the transverse conduit in which an outlet opening is fitted with a separate nozzle for producing a controlled water jet stream.

DETAILED DESCRIPTION OF A PREFERRED EMBODIMENT OF THE INVENTION

Figure 1:
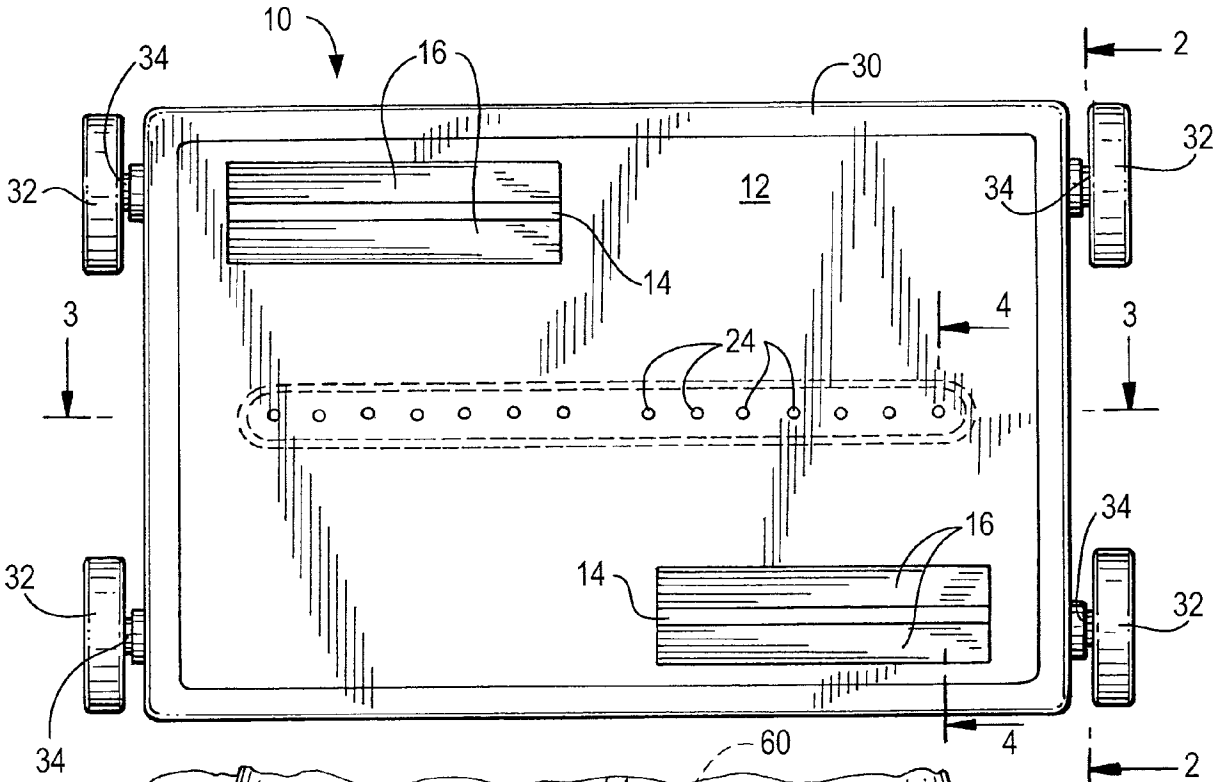
FIG. 1 is a bottom view of a pool or tank cleaner equipped with a base plate of the present invention.

Referring to FIG. 1, a bottom view of a pool cleaning apparatus 10 that is representative of the prior art includes the base plate 12, a pair of water inlet openings 14 that are each fitted with a pair of flaps 16 that open under the influence of the low pressure created on the interior of the pool cleaner housing 30 to draw water from beneath the base plate for filtration. Flaps 30 assume a closed overlapping position to prevent dirt and debris from passing through the inlet openings 14 when the flow of water is discontinued. The pool cleaning apparatus is provided with wheels 32 mounted on transverse axles 34 at the opposing ends of the housing 30. As used herein, the term "forward" and "forward end" have reference to the direction of travel, as being understood that the pool cleaner apparatus is generally symmetrical.

With continuing reference to FIG. 1, the transverse conduit 20 which is mounted on the interior surface of the base plate 12, and shown in broken lines, is provided with a plurality of spaced-apart outlet openings 24 which, in the embodiment illustrated, extend along the central transverse axis of the base plate at a position midway between the water inlet openings 14. As will be understood by one of ordinary skill in the art, and in particular with reference to U.S. Pat. No. 7,316,751 and others, the base plate may be provided with a single inlet or a plurality of inlets positioned at locations other than those shown in this illustrative embodiment. As shown, the respective groups of outlet openings 24 are generally aligned to the right and left of the longitudinal axis of the pool cleaner and correspond to the transverse dimensions of the water inlet openings 14.

Figure 2:
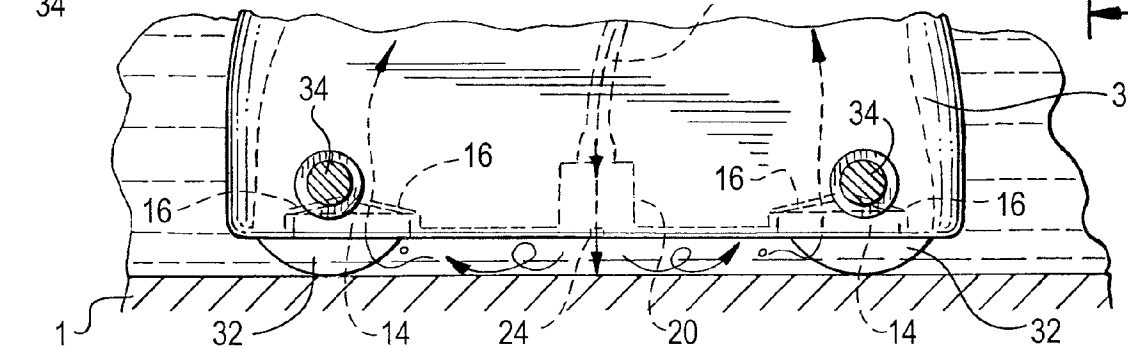
FIG. 2 is a partial side elevation sectional view of the cleaner of FIG. 1 taken along section line 2-2.

Referring now to the side view of FIG. 2, which is partly in section, the end of the transverse conduit 20 is shown with a pressurized water delivery conduit 60 positioned over a inlet fitting projecting above the top surface 26 of the conduit 20. In this view, respective flaps 16 are shown in the open position to admit water into the interior and to pass through the mesh filter 36.

Figure 3:
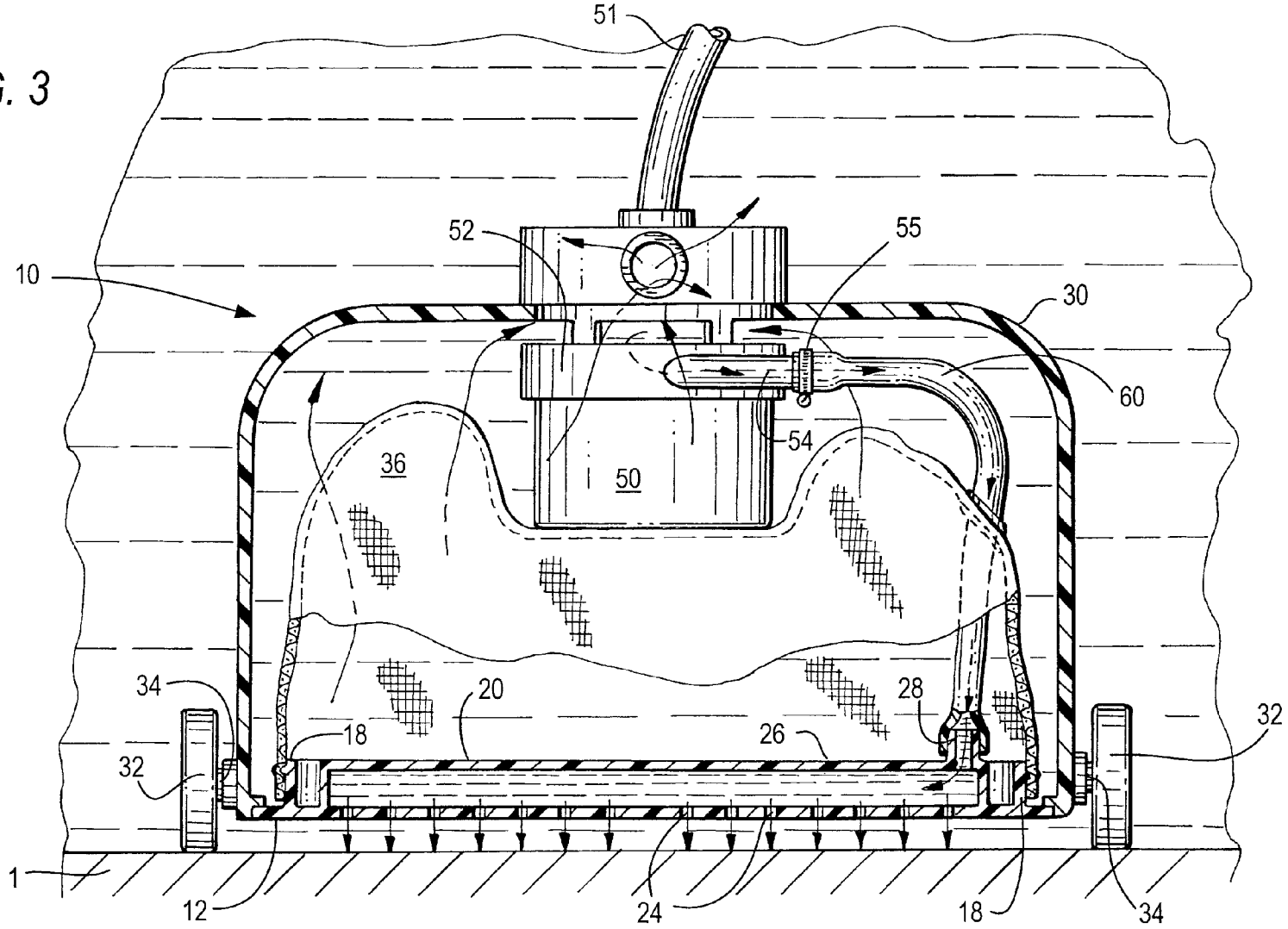
FIG. 3 is a front elevation sectional view of the pool cleaner of FIG. 1 taken along section line 3-3.

Further details are illustrated in the end view of FIG. 3 which shows the transverse conduit 20 in section taken along a line passing through the water outlet openings in the bottom wall of the conduit. Transverse conduit top wall 26 is provided with a vertically projecting cylindrical inlet or tube 28 which is configured to receive a high pressure tubular conduit the opposite end of which is connected to the outlet 54 of a pump assembly 52 mounted on pump motor 50. For convenience, the transverse conduit 20 is illustrated as of one-piece construction, with an integral top closure 26. As was previously described, the top wall or closure 26 can be a separate molded element that is secured in position on the end and side walls in watertight relation. The inlet tube is conveniently integrally formed with top wall 26. Inlet tube 28 can have a diameter of about 4 mm to 8 mm and is preferably dimensioned to receive a flexible polymeric water delivery tube in a secure frictional fit so that it can be removed and replaced when the housing and base plate are separated to clean the filter. Also illustrated is a power cord 51 for providing electrical current and, optionally, control signals for other features and electronic components (not shown) that can form part of the apparatus.

As will be understood by one of ordinary skill in the art, the high pressure water delivery conduit 60 is configured with a rounded right angle section to minimize the pressure losses due to turbulence. The positioning of the transverse conduit 20 and the high pressure water delivery conduit 60 within the confines of the housing 30 assures that these elements will not be damaged or dislodged by an inadvertent impact during handling by the user, e.g., when placing or removing the apparatus from the pool or storage area, or by individuals in the pool when the apparatus is present. In a preferred embodiment, the high pressure water delivery conduit 60 can be a polymeric tube which can be fitted to the pump outlet 54 and the transverse conduit inlet 28 in a frictional fit and/or secured by a conventional hose clamp 55.

Although the dimensions and configuration of the transverse conduit 20 are not critical, as shown in FIG. 3, it is positioned within the filter assembly which must be retained in position against the base plate, e.g., by retaining member 36 which extends from the interior surface of the base plate and engages the filter assembly in a frictional fitting relation. As will be understood by one of ordinary skill in the art, various filter systems and retaining means can be employed in the pool cleaning apparatus to which the base plate of the present invention can be assembled, either at the time of original manufacture or as an improved replacement when retrofitting a pool cleaner of the prior art. The filter system can include one or more cartridges located in the housing, or a remote pump and filter system located outside of the pool and in fluid communication via a hose to the pool cleaner. Such a system is well known in the art and can advantageously be utilized with the base plate of the present invention.

Various configurations of the water outlets extending from the interior of the transverse conduit and through the underside of the base plate or bottom of the transverse conduit will be described with reference to FIGS. 4 through 7. Referring first to the detail of FIG. 4, the transverse conduit 20 is shown partly in section to illustrate a water outlet opening 24 that is positioned generally vertically to direct a water jet to the surface immediately below the opening. FIGS. 5 and 6, respectively, show a single outlet opening 24 that is radially displaced from a line that is normal to the base plate in opposite directions. FIG. 7 illustrates an embodiment in which two outlet openings at the same transverse position are radially displaced from the normal in opposite directions. These configurations have the advantage of directing the water jet towards one or the other of the inlet openings 14.

Referring now to FIG. 8, an embodiment is illustrated in which the transverse conduit is formed as a separate member and secured into a separate opening 13 in the base plate 12. This opening 13 can be formed at the time of the molding of the base plate or the opening can be cut in the base plate after its production. The transverse conduit 20 can be provided with a flange or shoulder 21 that extends around its entire periphery to securely position the conduit in place in the base plate opening 13. As will be apparent to those of ordinary skill in the art, other known configurations can be provided to assist in the secure mating of the transverse conduit 20 with the base plate 12. As shown in FIG. 8, the exposed bottom surface of conduit 20 is flush with the exterior or bottom surface of the base plate 12, that is, the surface of the conduit does not project below the surface and the exterior of the base plate and the transverse conduit present a smooth, uninterrupted surface that will not engage any obstacles projecting upwardly from the bottom of the pool over which the apparatus is passing. This feature will minimize the possible interruption of the cleaning pattern and also eliminate any damage that might be caused to the apparatus by impact with such obstacles.

As will also be understood by one of ordinary skill in the art, a transverse conduit having a circular or other curvilinear configuration, and a generally flat bottom surface that will form a flush, or even a concave surface, can be provided in this embodiment. The separate transverse conduit can be secured by means of chemical adhesives that bond the contacting polymeric surfaces reactively, by an adhesive caulk that will also serve to assure a watertight joint between the elements, by ultrasonic means which cause a melting and bonding of the contacted surfaces, or by conventional mechanical fasteners, such as clips and brackets, or by forming additional molded elements extending upwardly from the base plate which can engage in a snap-fit with mating elements on the conduit 20.

Referring now to FIG. 9, a simplified view of a portion of the base plate 12 which forms the bottom wall of the transverse conduit 20 as described in connection with FIGS. 1 through 7 is shown in which a representative outlet opening 24 is fitted with a separate nozzle 70 that is selected to produce an enhanced water jet. In this embodiment, the outlet opening is enlarged to receive the nozzle. The throat 76 of the nozzle 70 can be of fixed configuration or, as illustrated, can be manually adjusted by the user by turning the exposed portion 72 that is provided with a knurled or other faceted surface to facilitate this adjustment to adapt it to the specific configurations of the pool in which the apparatus will be used.

As shown, this auxiliary nozzle 70 has an exterior projecting portion 72 which preferably has a low profile to avoid contact with objects extending above, or irregular areas in the surface of the pool over which the cleaner passes. Manual adjustment of the nozzle opening 76 serves to modify the force and/or configuration of the jet stream emitted. Non-adjustable nozzles having a fixed discharge stream with desired characteristics can also be employed in the embodiment of FIG. 9. A collar 78 extends into the downstream portion of the enlarged opening 24 and can be secured in position by use of a frictional interference or press fit, by a snap-fit employing engagement between a groove and a projecting element, by threads formed in the respective surfaces, and/or by bonding the mating surfaces of the collar 78 and opening 24 with adhesive. Any commercially available nozzle can be employed, and the specific mechanism forms no part of the present invention.

As will be apparent from the above description, the improved base plate of this invention avoids and resolves problems associated with prior art apparatus and systems, and provides an efficient and robust system for delivering high pressure water jets to the surface under the base plate to facilitate the capture of dirt and debris in the filter system. Although various embodiments have been illustrated in the drawings and described above, modifications and alterations based on this disclosure will become apparent to those of ordinary skill in the art and the scope of protection is to be determined by the claims that follow.

We claim:

1. A base plate for a pool or tank cleaner, the cleaner including a housing, movable support means for contacting a surface of the pool or tank, a filter for capturing debris from water passing through the housing, a source of pressurized water and a pressurized water delivery conduit extending from the source of pressurized water, the base plate comprising:

an exterior surface that faces the surface of the pool or tank and an opposite interior surface, a transverse conduit that extends across the interior surface of the base plate transverse to the longitudinal axis of the cleaner as defined by the direction of travel, a plurality of downwardly directed outlet openings extending from the interior of the transverse conduit and through the exterior surface of the base plate, one or more water inlet openings to admit water from below the base plate to pass through the filter, where the plurality of transverse conduit openings are positioned to direct water jets toward the surface of the pool or tank below each of the one or more water inlet openings, a transverse conduit inlet port for admitting a stream of pressurized water into the interior of the transverse conduit, the inlet port configured to mate in watertight relation for fluid communication with the pressurized water delivery conduit.

2. The base plate of claim 1 in which the plurality of outlet openings have a uniform cross-section throughout their length.

3. The base plate of claim 2 in which the openings are circular and have an outlet diameter in the range of from 0.5 mm to 1.5 mm.

4. The base plate of claim 1 in which the longitudinal axes of at least a portion of the plurality of openings are angularly displaced from a vertical plane extending through the longitudinal axis of the transverse conduit.

5. The base plate of claim 1 in which the transverse conduit inlet port is tubular and extends from the surface of the transverse conduit that is opposite the base plate.

6. The base plate of claim 5 in which the pressurized water delivery conduit engages the tubular inlet port in a secure frictional slip fit.

7. The base plate of claim 1 in which a portion of the interior surface of the base plate comprises a bottom wall of the transverse conduit.

8. The base plate of claim 1 which is a molded polymeric material and at least a portion of the walls of the transverse conduit are integrally molded with the base plate.

9. The base plate of claim 8 in which the transverse conduit is of a generally rectilinear configuration formed by opposing side walls that extend upwardly from, and are integrally molded with the base plate, and a separate top wall that is secured to an upper portion of the respective side walls, the top wall including the inlet port.

10. The base plate of claim 9 in which the transverse conduit includes a bottom wall that is a portion of the base plate, opposing transverse side walls and adjoining end walls that are integral with the base plate and a top wall secured to the upper portions of the side walls and end walls.

11. The base plate of claim 1 in which the transverse conduit is centrally positioned on the interior surface of the base plate.

12. The base plate of claim 1 in which the exterior surface is substantially planar.

13. A pool or tank cleaner that includes the base plate of claim 1.

14. A base plate for a pool or tank cleaner, the cleaner including a housing, movable support means for contacting a surface of the pool or tank, a filter for capturing debris from water passing through the housing, a source of pressurized water and a pressurized water delivery conduit extending from the source of pressurized water, the base plate comprising:

an exterior surface that faces the surface of the pool or tank and an opposite interior surface, a transverse conduit that extends across the interior surface of the base plate transverse to the longitudinal axis of the cleaner as defined by the direction of travel, a plurality of downwardly directed outlet openings extending from the interior of the transverse conduit and through the exterior surface of the base plate in which at least a portion of the plurality of openings are each provided with an adjustable auxiliary jet nozzle, one or more water inlet openings to admit water from below the base plate to pass through the filter, where the plurality of transverse conduit openings are positioned to direct water jets toward the surface of the pool or tank below each of the one or more water inlet openings, a transverse conduit inlet port for admitting a stream of pressurized water into the interior of the transverse conduit, the inlet port configured to mate in watertight relation for fluid communication with the pressurized water delivery conduit.

15. The base plate of claim 14 in which each nozzle is manually adjustable to control the force and/or direction of the discharged water jet.

16. A base plate for a pool or tank cleaner, the cleaner including a housing, movable support means for contacting a surface of the pool or tank, a filter for capturing debris from water passing through the housing, a source of pressurized water and a pressurized water delivery conduit extending from the source of pressurized water, the base plate comprising:

an exterior surface that faces the surface of the pool or tank and an opposite interior surface, a transverse conduit that extends across the interior surface of the base plate transverse to the longitudinal axis of the cleaner as defined by the direction of travel, wherein the transverse conduit is a separate element that is secured in mating alignment with a corresponding opening extending transversely across the base plate, a plurality of downwardly directed outlet openings extending from the interior of the transverse conduit and through the exterior surface of the base plate, one or more water inlet openings to admit water from below the base plate to pass through the filter, where the plurality of transverse conduit openings are positioned to direct water jets toward the surface of the pool or tank below each of the one or more water inlet openings, a transverse conduit inlet port for admitting a stream of pressurized water into the interior of the transverse conduit, the inlet port configured to mate in watertight relation for fluid communication with the pressurized water delivery conduit.

* * * * *